US009370942B2

(12) United States Patent
Ohnishi

(10) Patent No.: US 9,370,942 B2
(45) Date of Patent: Jun. 21, 2016

(54) INKJET PRINTER AND INKJET PRINTING METHOD

(75) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 186 days.

(21) Appl. No.: 13/391,287

(22) PCT Filed: Aug. 20, 2010

(86) PCT No.: PCT/JP2010/005156

§ 371 (c)(1), (2), (4) Date: Feb. 19, 2012

(87) PCT Pub. No.: WO2011/021403

PCT Pub. Date: Feb. 24, 2011

(65) Prior Publication Data

US 2012/0147109 A1 Jun. 14, 2012

(30) Foreign Application Priority Data

Aug. 21, 2009 (JP) ..... 2009-192231

(51) Int. Cl.
*B41J 11/00* (2006.01)
*B41J 11/42* (2006.01)
(Continued)

(52) U.S. Cl.
CPC *B41J 11/002* (2013.01); *B41J 2/14* (2013.01); *B41J 2/2114* (2013.01); *B41J 11/0015* (2013.01); *B41J 11/42* (2013.01); *B41J 29/393* (2013.01); *B41J 2202/02* (2013.01)

(58) Field of Classification Search
CPC ..... B41J 11/002; B41J 11/0015; B41J 11/42; B41J 29/393; B41J 2202/02; B41J 2/14
USPC ..... 347/102, 16, 21, 101; 101/488; 219/216; 346/25
See application file for complete search history.

(56) References Cited

U.S. PATENT DOCUMENTS 2,712,704 A * 7/1955 Mason ..... 428/182
3,922,484 A * 11/1975 Keller ..... 358/534
(Continued)

FOREIGN PATENT DOCUMENTS

EP 1629979 3/2006
JP 05282500 A * 10/1993
(Continued)

OTHER PUBLICATIONS

Machine Translation for Inose (JP Pat 2002292840).*
(Continued)

*Primary Examiner* — Bradley Thies
(74) *Attorney, Agent, or Firm* — Jianq Chyun IP Office

(57) ABSTRACT

Disclosed is a printing method whereby a glossy image free of running can be printed by an inkjet printer. An inkjet head (14) is caused to scan in the Y direction to print outline portions (32 and 33) on a medium (31). Next, immediately after the printing of the outline portions, a first UV irradiation means (15 or 16) disposed coaxially with the scanning axis of the inkjet head irradiates ink at the outline portions with UV light to harden the ink at the outline portions to prevent running. Next, the inkjet head prints a solid portion (34) between the outline portion (32) and the outline portion (33), and a second UV irradiation means (17) disposed forward in the scanning direction (X direction) of the medium (31) hardens the ink at the solid portion.

8 Claims, 5 Drawing Sheets

(51) Int. Cl.

| | |
|---|---|
| ***B41J 29/393*** | (2006.01) |
| ***B41J 2/14*** | (2006.01) |
| ***B41J 2/21*** | (2006.01) |

(56) References Cited

U.S. PATENT DOCUMENTS

| | | | | |
|---|---|---|---|---|
| 4,816,350 | A * | 3/1989 | Horiuchi et al. | 428/690 |
| 5,414,453 | A * | 5/1995 | Rhoads et al. | 347/8 |
| 5,606,628 | A * | 2/1997 | Miyabe et al. | 382/183 |
| 5,617,216 | A * | 4/1997 | Wada | 358/2.1 |
| 5,661,507 | A * | 8/1997 | Sperry | 347/9 |
| 5,751,929 | A * | 5/1998 | Ohnuma et al. | 345/600 |
| 6,224,189 | B1 * | 5/2001 | Kletter | 347/43 |
| 6,247,787 | B1 * | 6/2001 | Giere et al. | 347/40 |
| 6,676,311 | B2 * | 1/2004 | Benger | 400/76 |
| 6,712,441 | B2 * | 3/2004 | Sato et al. | 347/15 |
| 6,902,331 | B1 * | 6/2005 | Raman | 400/61 |
| 6,905,538 | B2 * | 6/2005 | Auslander | 106/31.15 |
| 7,134,749 | B2 * | 11/2006 | Ben-Zur et al. | 347/101 |
| 7,261,407 | B2 * | 8/2007 | Nishikawa et al. | 347/102 |
| 7,396,098 | B2 * | 7/2008 | Kanematsu et al. | 347/15 |
| 7,830,557 | B2 * | 11/2010 | Simske et al. | 358/3.28 |
| 8,398,700 | B2 * | 3/2013 | Leopold et al. | 623/1.12 |
| 2001/0020964 | A1 * | 9/2001 | Irihara et al. | 347/43 |
| 2002/0001005 | A1 * | 1/2002 | Kneezel et al. | 347/15 |
| 2002/0135626 | A1 * | 9/2002 | Sato et al. | 347/15 |
| 2004/0113961 | A1 * | 6/2004 | Ishikawa | 347/11 |
| 2005/0104946 | A1 * | 5/2005 | Siegel | 347/102 |
| 2006/0227397 | A1 * | 10/2006 | Goma et al. | 358/521 |
| 2007/0126792 | A1 * | 6/2007 | Couwenhoven et al. | 347/43 |
| 2009/0244158 | A1 * | 10/2009 | Hara | 347/16 |
| 2010/0025598 | A1 * | 2/2010 | Short et al. | 250/493.1 |
| 2010/0054609 | A1 * | 3/2010 | Kusakabe | 382/203 |
| 2010/0157376 | A1 * | 6/2010 | Kulpa et al. | 358/3.27 |
| 2011/0025745 | A1 * | 2/2011 | Izawa et al. | 347/14 |
| 2011/0069128 | A1 * | 3/2011 | Onishi | 347/102 |
| 2011/0090276 | A1 * | 4/2011 | Hirano | 347/14 |
| 2011/0111181 | A1 * | 5/2011 | Shang | 428/173 |
| 2011/0310154 | A1 * | 12/2011 | Mantell | 347/15 |
| 2012/0062667 | A1 * | 3/2012 | Roof et al. | 347/102 |

FOREIGN PATENT DOCUMENTS

| | | | |
|---|---|---|---|
| JP | 2002-292840 | | 10/2002 |
| JP | 2003288018 | A * | 10/2003 |
| JP | 2004017509 | A * | 1/2004 |
| JP | 2004-306469 | | 11/2004 |
| JP | 2005067073 | A * | 3/2005 |
| JP | 2005-342897 | | 12/2005 |
| JP | 2006-248042 | | 9/2006 |
| JP | 2007-112117 | | 5/2007 |
| JP | 2007-136811 | | 6/2007 |
| JP | 2007-161887 | | 6/2007 |
| JP | 2008-265285 | | 11/2008 |
| JP | 2009-012289 | | 1/2009 |
| JP | 2009190297 | A * | 8/2009 |

OTHER PUBLICATIONS

Machine Translation for JP 2004017509 A.*
Machine Translation for JP 2009190297 A.*
"1st Office Action of China Counterpart Application", with English translation thereof, issued on Nov. 20, 2013, p. 1-p. 21.
"Second Office Action of China Counterpart Application", issued on Sep. 19, 2014, pp. 1-6, with English translation thereof.
"Office Action of Japan Counterpart Application", issued on Jul. 17, 2012, pp. 1-11, with English translation thereof.
"Office Action of Japan Counterpart Application", issued on Feb. 4, 2014, pp. 1-11, with English translation thereof.
"Office Action of Japan Counterpart Application", issued on Sep. 24, 2014, pp. 1-6, with English translation thereof.
"Office Action of Korea Counterpart Application", mailed on Apr. 29, 2013, pp. 1-9, with English translation thereof.
"The Extended European Search Report of European Counterpart Application", issued on Dec. 9, 2013, pp. 1-8.

* cited by examiner

INKJET PRINTER AND INKJET PRINTING METHOD

CROSS-REFERENCE TO RELATED APPLICATION

This application is a 371 of international application of PCT application serial no. PCT/JP2010/005156, filed on Aug. 20, 2010, which claims the priority benefit of Japan application no. 2009-192231, filed on Aug. 21, 2009. The entirety of each of the above-mentioned patent applications is hereby incorporated by reference herein and made a part of this specification.

TECHNICAL FIELD

The present invention relates to an inkjet printer and an inkjet printing method by which an image formed of an array of ink droplets is printed by spraying the ink droplets from an inkjet head.

BACKGROUND ART

Among printing methods using an inkjet printer, a method is known in the art in which an UV curable ink is sprayed from an inkjet head and deposited on a printing medium, and then the ink droplets on the printing medium are cured and fixed to the printing medium by irradiating an ultraviolet light thereby printing an image on the printing medium. For example, Patent Document 1 discloses an image forming apparatus that has a compact structure and that accelerates curing of ink after the image is printed on a recording medium.

The UV curable ink has an advantage that it can be used on a non-absorbent printing medium. However, the UV curable ink has disadvantages that its characteristics change with changes in characteristics of the printing medium or changes in the environmental temperature. Moreover, spreading of ink on the printing medium continues until the UV curable ink reaches a stable area that is determined by a contact angle with the printing medium and a surface tension of the printing medium before the ink is cured and fixed by exposing to the ultraviolet light.

CONVENTIONAL ART DOCUMENTS

Patent Documents

Patent Document 1: Japanese Patent Application Laid-open No. 2009-12289

DISCLOSURE OF INVENTION

Problem to be Solved by the Invention

Transparent UV curable inks are known in the art that are devoid of pigments. Such UV curable inks are typically used for creating glossy images, as an overcoat over a color print, or as a coating, etc., over a printing medium. However, an irregularity is formed on a printed surface depending on the viscosity of the ink deposited on the printing medium from an inkjet head, or a grayscale of the image to be formed on the printing medium. An uneven gloss is formed due to a difference in reflectivity that occurs due to the irregularity formed on the surface. To prevent this from happening, a measure is taken in which a viscosity of the ink is reduced and the ultraviolet light is irradiated after a lapse of a certain time, i.e., after the irregularity is flattened due to lapse of the time. With this method, the print image can be flattened; however, during the flattening process, ink runs and borders of the image become blurred. Specifically, when scales are provided on a printing medium, such as, a transparent glass, or marks are provided for alignment, alignment accuracy is likely to be reduced due to running of the ink.

The present invention is made in view of the above discussion. It is an object of the present invention to provide an inkjet printer and an inkjet printing method by which a running-free clear image having a high-gloss can be obtained.

Means to Solve the Problems

To solve the above problems, the present invention has following structure.

(Structure 1)

An inkjet printing method by which an image formed of an array of ink droplets is printed on a surface of a printing medium by an inkjet head that scans relative to the printing medium and includes a plurality of discharge ports to spray ink in the form of droplets, based on an image data that includes an image area portion divided into a plurality of image areas and a border portion that divides the image area portion, the ink being an energy light curable ink, the inkjet printing method sequentially comprising:

a border printing step of printing the border portion;

a border curing step of curing the printed border portion by irradiating an energy light;

an image area printing step of printing the image area portion adjacent to the border portion that is cured at the border curing step; and an image area curing step of curing the printed image area portion by the energy light.

(Structure 2)

The inkjet printing method according to Structure 1, wherein the border curing step is performed by an energy-light irradiation unit that is arranged at least either frontward or backward in a scanning direction of the inkjet head coaxially with a scanning axis of the inkjet head, and that operates with the inkjet head.

(Structure 3)

The inkjet printing method according to Structure 1 or 2, wherein the image area curing step is performed by an energy-light irradiation unit that is arranged frontward in a conveyance direction of the printing medium relative to the inkjet head.

(Structure 4)

The inkjet printing method according to Structure 1, 2, or 3, wherein at least either the ink constituting the border portion or the ink constituting the image area portion is a clear ink.

(Structure 5)

The inkjet printing method according to Structure 4, wherein the ink constituting the border portion and the ink constituting the image area portion are printed such that both the inks overlap with each other in borders thereof.

(Structure 6)

The inkjet printing method according to any one of Structures 1 to 5, wherein printing is performed such that the border portion is formed by an array of ink droplets that are smaller than that of the image area portion.

(Structure 7)

The inkjet printing method according to Structure 6, wherein the printing is performed by an inkjet head that includes ink discharge nozzles having different nozzle diameters of more than or equal to two types.

(Structure 8)

The inkjet printing method according to any one of Structures 1 to 7, wherein the image area curing step is performed by irradiating the image area portion with the energy light after the ink of the image area portion printed at the image area printing step is flattened.

(Structure 9)

The inkjet printing method according to any one of Structures 1 to 8, further comprising, prior to the border printing step, an image data splitting step of splitting print-targeted image data into the image area portion that is divided into a plurality of image areas and the border portion that divides the image area portion.

(Structure 10)

An inkjet printer that prints by an inkjet head that scans relative to a printing medium and discharges ink droplets according to an image data that includes an image area portion that is divided into a plurality of image areas and a border portion that divides the image area portion, the ink being an energy-light curable ink, the inkjet printer comprising:

an energy-light irradiation unit that cures the border portion printed by the inkjet head before the inkjet head prints the image area portion, and cures the image area portion printed by the inkjet head after the border portion is cured.

(Structure 11)

The inkjet printer according to Structure 10, wherein the energy-light irradiation unit includes a first energy-light irradiation unit that cures the border portion printed by the inkjet head before printing the image area portion by the inkjet head; and a second energy-light irradiation unit that cures the image area portion printed by the inkjet head after the border portion is cured by the first energy-light irradiation unit.

(Structure 12)

An inkjet printer comprising:

a platen that supports a printing medium;

a conveying unit that conveys the printing medium;

an inkjet head that includes a plurality of discharge ports, and sequentially prints an outline portion and a solid portion of an image by scanning relative to the printing medium;

a first energy-light irradiation unit for curing the outline portion, that is arranged at least either frontward or backward in a scanning direction of the inkjet head coaxially with a scanning axis of the inkjet head, and that operates with the inkjet head; and a second energy-light irradiation unit for curing the solid portion, that is arranged frontward in a conveyance direction of the printing medium relative to the inkjet head, and that operates with the inkjet head.

(Structure 13)

An inkjet printer comprising:

a platen that supports a printing medium;

a conveying unit that conveys the printing medium;

an inkjet head that includes a plurality of discharge ports, and sequentially prints an outline portion and a solid portion of an image by scanning relative to the printing medium; and an energy-light irradiation unit that is arranged at least either frontward or backward in a scanning direction of the inkjet head coaxially with a scanning axis of the inkjet head, and movable in both directions between a position on the scanning axis and a predetermined position on a front side in the conveyance direction of the printing medium.

Advantages of the Invention

According to Structure 1 of the present invention, a border portion from among image data is printed with energy-light curable ink, and immediately after that, the border portion is cured by an energy light. Therefore, excess spreading of ink of an image area portion is prevented due to the presence of the cured border portion, and as a result, an image with high clarity that is devoid of running is printed.

According to Structure 2 of the present invention, a border curing process is executed immediately after execution of a border printing process by an energy-light irradiation unit that is arranged at least either frontward or backward in a scanning direction of an inkjet head coaxially with a scanning axis of the inkjet head, and that operates with the inkjet head. Therefore, the border portion is effectively prevented from running, and as a result, a clear image is obtained.

According to Structure 3 of the present invention, an image area curing process is executed by an energy-light irradiation unit that is arranged frontward in a conveyance direction of the printing medium relative to the inkjet head. Therefore, a time for flattening the image area portion is ensured, and as a result, a high-gloss image is obtained.

According to Structure 4 of the present invention, when at least either the ink constituting the border portion or the ink constituting the image area portion is a clear ink, a clear and high-gloss image is obtained.

According to Structure 5 of the present invention, the ink constituting the border portion and the ink constituting the image area portion are printed such that both the inks overlap with each other in borders thereof. Therefore, a gap that is likely to be formed between the border portion and the image area portion is avoided.

According to Structure 6 of the present invention, printing is performed such that the border portion is formed by an array of ink droplets that are smaller than that of the image area portion. Therefore, a desired shape of the border portion is obtained more accurately, and printing of the image area portion is performed effectively and rapidly.

According to Structure 7 of the present invention, the printing described in Structure 6 is performed using an inkjet head that includes ink discharge nozzles having different nozzle diameters of more than or equal to two types. Therefore, advantages similar to that of Structure 6 are obtained.

According to Structure 8 of the present invention, the image area portion is cured by irradiating the energy light after the ink of the image area portion is flattened. Therefore, the light is prevented from scattering on the image area portion, and a high-gloss image is obtained.

According to Structure 9 of the present invention, the print-targeted image data is split into the image area portion that is divided into a plurality of image areas and the border portion that divides the image area portion. Therefore, various printing images can be represented by setting borders as per the requirement.

According to Structures 10 and 11 of the present invention, the image area portion is printed and cured after the border portion is cured. Therefore, the image area portion that is reliably divided by the border portion is printed, and as a result, the image area portions are prevented from running.

According to Structure 12 of the present invention, an inkjet printer includes a first energy-light irradiation unit for curing the border portion, that is arranged at least either frontward or backward in the scanning direction of the inkjet head coaxially with a scanning axis of the inkjet head, and that operates with the inkjet head, and a second energy-light irradiation unit for curing the image area portion, that is arranged frontward in the conveyance direction of the printing medium relative to the inkjet head, and that operates with the inkjet head. With the energy-light irradiation units, the border portion can be cured immediately after the border portion is printed, and thereafter, the image area portion can be printed and cured after a lapse of a certain period. That is, because the border portion is cured immediately after it is printed, a clear border devoid of running is formed. The border portion can restrain excessive spreading of ink of the image area portion. The image area portion can be flattened by curing the image area portion after a lapse of a certain period, and therefore, a high-gloss image is obtained.

According to Structure 13 of the present invention, the inkjet printer includes an energy-light irradiation unit that is arranged at least either frontward or backward in the scanning direction of the inkjet head coaxially with the scanning axis of the inkjet head, and movable in both directions between the position on the scanning axis and a predetermined position on the front side in the conveyance direction of the printing medium. With the energy-light irradiation unit, energy light irradiation is enabled immediately after a portion is printed by the inkjet head. Furthermore, by moving the irradiation unit on the front side in the conveyance direction of the printing medium, the image that is printed on the printing medium and conveyed is irradiated with the energy light after a lapse of a certain period. That is, because the border portion is cured immediately after it is printed, a clear border devoid of running is formed. Thereafter, the image area portion is printed and cured by flattening it after a lapse of a certain period. As a result, a clear and high-gloss image is obtained.

DESCRIPTION OF EMBODIMENTS

Figure 1:
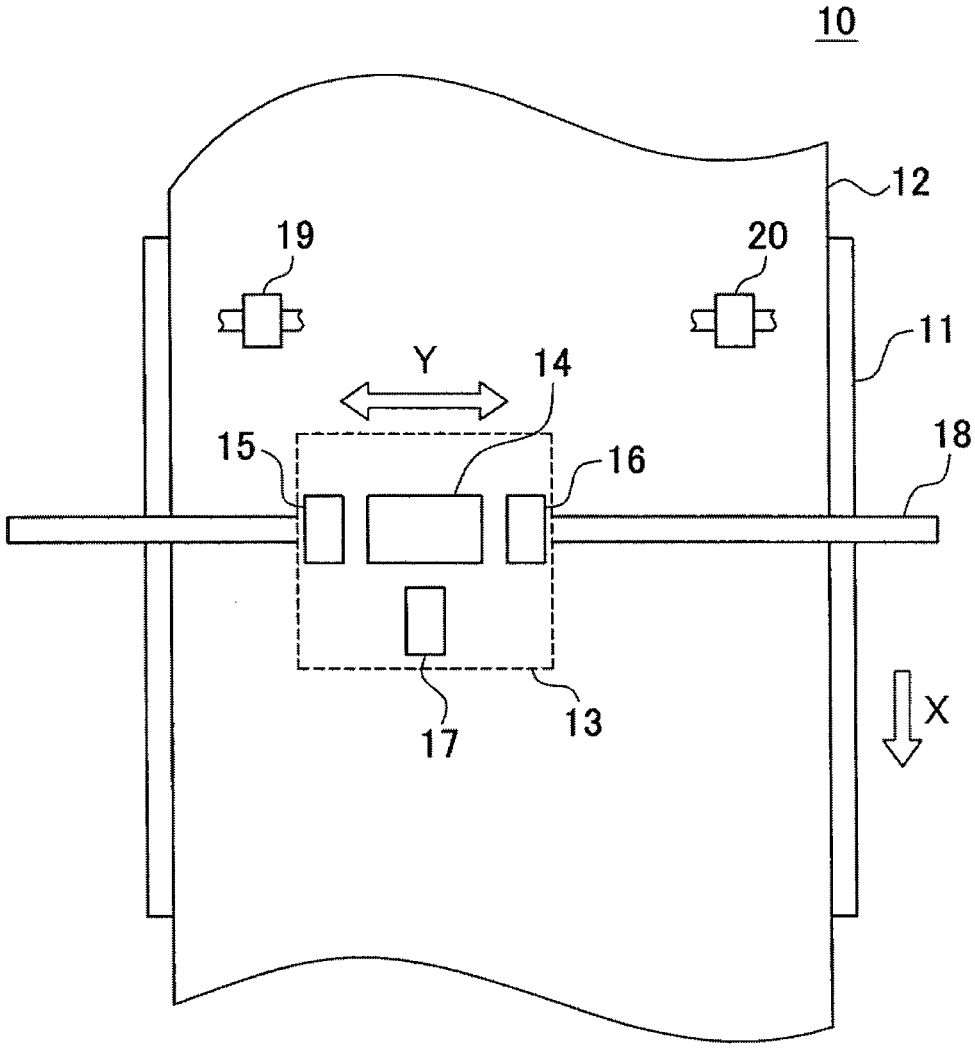
FIG. 1 is a schematic top view of relevant elements of an inkjet printer according to the present invention.

Exemplary embodiments of an inkjet printer and a printing method according to the present invention are explained below with reference to the accompanying drawings. FIG. 1 is a schematic top view of relevant elements of the inkjet printer. Each of FIGS. 2 and 3 depicts a top view and a cross-sectional view for explaining a printing process.

The inkjet printer according to the present invention is explained first.

An inkjet printer 10 according to the present invention includes a platen (supporting body) 11 that supports a medium (printing medium) 12, pinch rollers 19 and 20 that convey the printing medium 12, and a plurality of discharge ports. Furthermore, the inkjet printer 10 includes an inkjet head 14 that two-dimensionally scans the printing medium 12 to print a border portion (outline portion) and an image area portion (solid portion) of an image in the same sequence, first ultraviolet irradiation units 15 and 16 for curing the outline portion and that are arranged frontward and backward in a scanning direction of the inkjet head 14 coaxially with a scanning axis (guide rail 18) of the inkjet head 14, and that operate with the inkjet head 14, and a second ultraviolet irradiation unit 17 for curing the solid portion that is arranged frontward in a conveyance direction of the printing medium relative to the inkjet head 14, and that operates with the inkjet head. The scanning direction of the inkjet head is a Y direction and the conveyance direction of the printing medium is an X direction. The Y direction and the X direction are orthogonal to each other.

The printing medium 12 is supported by the platen 11, and sandwiched between the pinch rollers 19 and 20 and not shown feed rollers. As the scanning of the printing medium 12 is finished from one end to other end in the Y direction by the inkjet head 14 while discharging the ink, the printing medium 12 is conveyed in the X direction by the rotation of the rollers.

The printing medium 12, which is made from almost all materials, for example, a plastic material, such as, PET, PP, PC, and acrylic, a metal, glass, vinyl chloride, a rubber material, or a paper, can be used.

The inkjet head 14 sprays ink droplets from not shown nozzles using a piezo method. The nozzles are arranged in a line at a bottom surface of the inkjet head 14. The inkjet head 14 is fixed to a unit mount 13, and scanned over the guide rail 8 in the Y direction by a not shown scanning unit. The scanning unit includes an electric motor, an electronic circuit for controlling the electric motor, etc.

Each of the ultraviolet irradiation units 15, 16, and 17 has an inbuilt UVLED (abbreviation of Ultra Violet Light Emitting Diode). The ultraviolet irradiation units 15, 16, and 17 are arranged on the unit mount 13 along with the inkjet head 14, and scanned in the Y direction using a not shown moving unit. The first ultraviolet irradiation units 15 and 16 are arranged frontward and backward in the scanning direction of the inkjet head 14 coaxially with the scanning axis (guide rail 18) of the inkjet head. On the other hand, the second ultraviolet irradiation unit 17 is arranged frontward in the conveyance direction (X direction) of the printing medium 12 relative to the inkjet head 14. The ultraviolet irradiation units 15, 16, and 17 irradiate the ultraviolet light onto the UV curable ink, which is sprayed from the inkjet head and deposited on the printing medium 12, to cure and fix the ink.

The second ultraviolet irradiation unit 17 is arranged at a position that ensures sufficient time for flattening the ink of the solid portion deposited on the printing medium 12. In another embodiment, the position of the second ultraviolet irradiation unit 17 is suitably adjusted according to a scanning speed of an inkjet head, a conveyance speed of a printing medium, environmental temperature, and an ink type.

A UVLED lamp described above can be most suitably used as an ultraviolet irradiation unit, although not particularly limited thereto. With the UVLED lamp, an amount of an irradiation light can be freely adjusted by changing an electric current or a light emission pulse width and ON/OFF control is enabled; therefore, less power is consumed. However, other lamps, such as, metal halide lamp, xenon lamp, and high-pressure mercury can be similarly used; because, an amount of the ultraviolet light output from such lamps can be controlled by using a shutter.

In the above-described embodiment, a case is explained where the ultraviolet light is used as an energy-light curable unit; however, any other energy light, such as, an electron beam can also be used.

As described above, in the inkjet printer 10 of the present invention, after the outline portion of a predetermined place is printed by scanning the inkjet head 14 in the Y direction on the surface of the printing medium 12 that is supported by the platen (supporting body) 11, the ink of the outline portion is cured by the first ultraviolet irradiation units 15 and 16. Subsequently, after the solid portion of a predetermined place is printed by scanning the inkjet head in the Y direction, the solid portion is cured by the second ultraviolet irradiation unit 17 by conveying the printing medium 12 in the X direction.

Figure 2A:
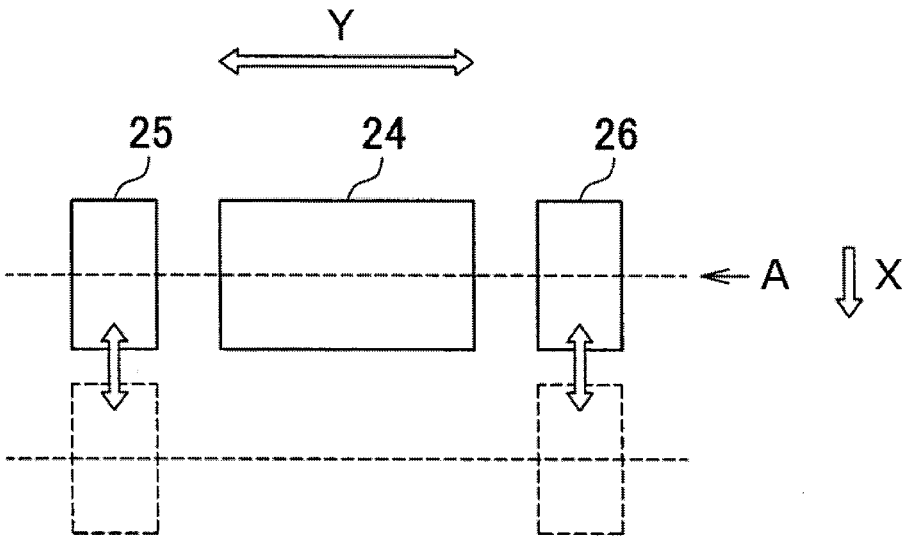
FIGS. 2A and 2B are schematic representations of an ultraviolet irradiation unit in the inkjet printer according to the present invention.
Figure 2B:
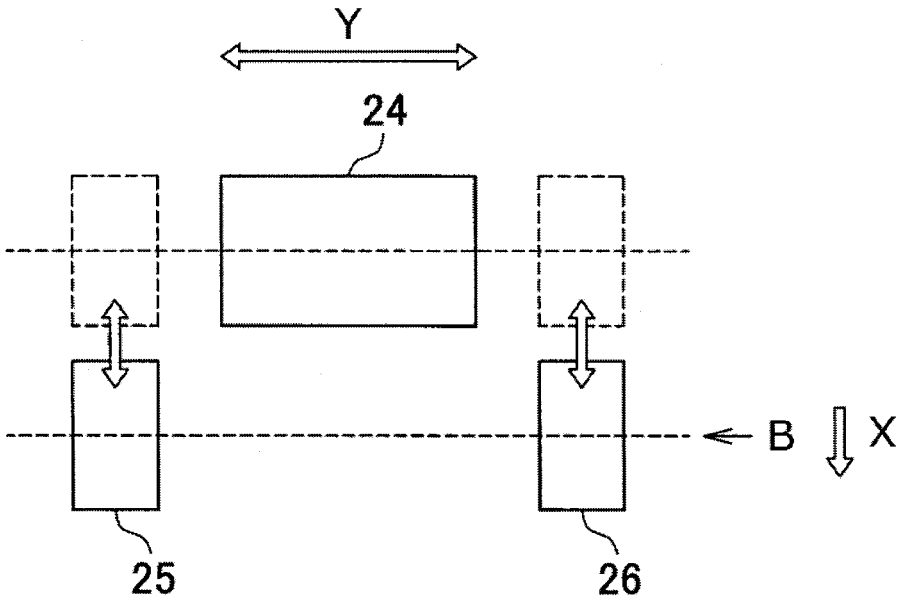

Ultraviolet irradiation units and a printing method according to another embodiment are explained next. FIGS. 2A and 2B are schematic top views of positions of the ultraviolet irradiation units.

As shown in FIG. 2A, ultraviolet irradiation units 25 and 26 are arranged frontward and backward in a scanning direction (Y direction) of an inkjet head 24 coaxially with a scanning axis (position A) of the inkjet head 24. The ultraviolet irradiation units 25 and 26 are movable in both directions between the position on the scanning axis and a predetermined position on the front side in a conveyance direction of a printing medium. The ultraviolet irradiation units 25 and 26 cure the ink of the outline portion (border curing process) immediately after the outline portion of an image is printed by the inkjet head 24 (border printing process). Thus, because there is no spreading of the ink droplets of the outline portion, a clear image devoid of running can be obtained.

After the solid portion of the image is printed by the inkjet head 24 (image area printing process), as shown in FIG. 2B, the ultraviolet irradiation units 25 and 26 are moved by the not shown moving unit to a position B that is a conveyance direction of the printing medium at the same time when the printing medium is conveyed and the ink of the solid portion is cured. By curing the ink of the solid portion at the position B (image area curing process), the time for flattening the ink of the solid portion is ensured. The position B can be appropriately determined by considering the conveyance time of the printing medium, a printing area of the solid portion of an image, environmental temperature, etc. A high-gloss image can be obtained with high clarity by curing the ink after flattening it.

As described above, according to the present invention, because curing is performed immediately after the outline portion is printed, a clear image of the outline portion devoid of running is obtained. Furthermore, because curing is performed after the solid portion is flattened, a glossy image is obtained. That is, according to the present invention, the ink can be prevented from running as well as the ink can be flattened. Thus, a clear and high-gloss image can be obtained.

While printing the outline portion, it is desirable to select a thin line having a line thickness of 1 dot line or greater to 2 to 15 dots line or less. However, the line thickness can vary depending on the type of the ink or a positional accuracy of a printing medium and a printer. Therefore, it is desirable to suitably adjust the line thickness without limiting to that described above.

The printing method of the present invention is explained with reference to FIG. 1 and FIGS. 3 and 4. Ultraviolet irradiation units are explained with reference to the aspect shown in FIG. 1.

Figure 3A:
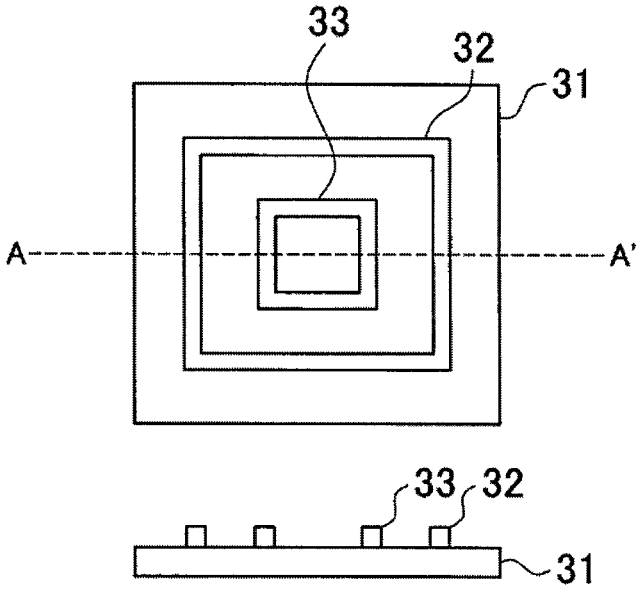
FIG. 3A is a top view and FIG. 3B is a cross-sectional view for explaining a printing method according to the present invention.

As shown in FIG. 3A, outline portions 32 and 33 are printed on a printing medium 31 by scanning the inkjet head 14 in the Y direction.

Figure 3B:
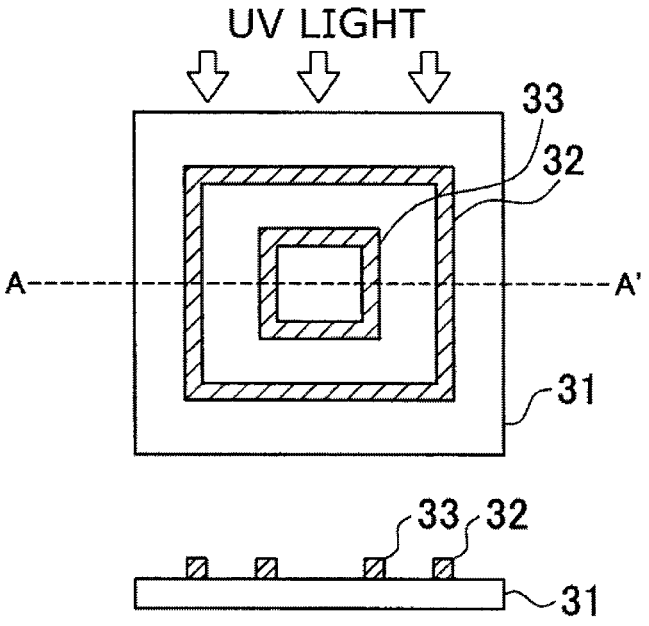

As shown in FIG. 3B, immediately after printing the outline portion, the ultraviolet light is irradiated by the first ultraviolet irradiation unit 15 or 16, which is arranged coaxially with the scanning axis of the inkjet head (see FIG. 1), to cure the ink of the outline portion so as to form a barrier. The cured outline portion prevents running of the ink of the solid portion, and as a result, an image with high clarity can be obtained.

Figure 4A:
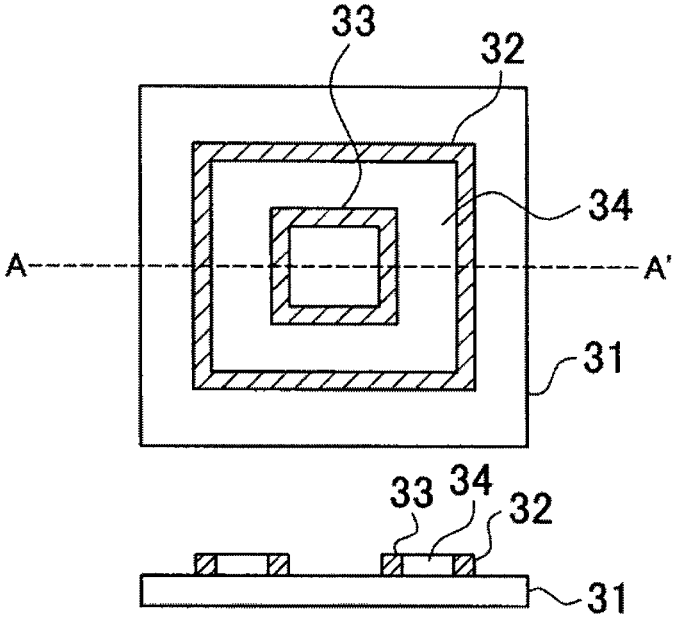
FIG. 4A is a top view and FIG. 4B is a cross-sectional view for explaining the printing method according to the present invention.

As shown in FIG. 4A, a solid portion 34 between the outline portions 32 and 33 is printed by the inkjet head without irradiating the ultraviolet light or while irradiating a weak ultraviolet light that does not cure the ink. Because the cured outline portion prevents running of the ink of the solid portion, an image with high clarity can be obtained.

Figure 4B:
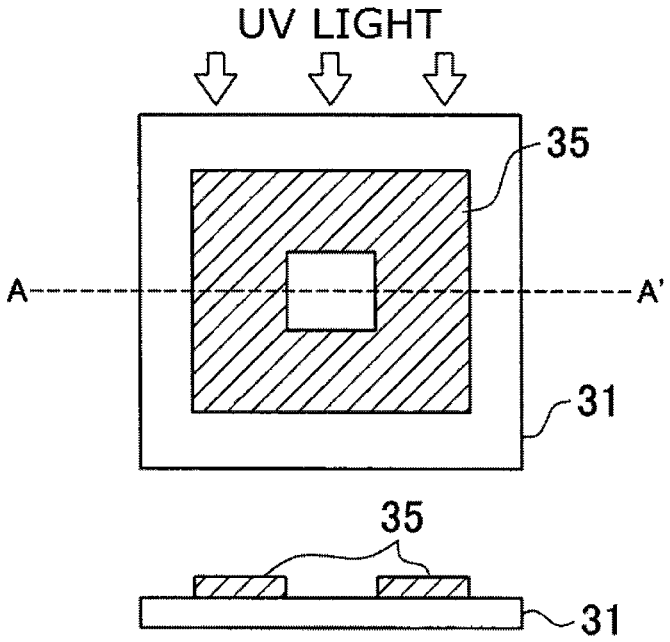

Eventually, as shown in FIG. 4B, the printing medium 31 is conveyed in the X direction and the ink of the solid portion is cured by the second ultraviolet irradiation unit 17 arranged frontward in the X direction (see FIG. 1). By arranging the second ultraviolet irradiation unit 17 frontward in the conveyance direction (X direction) of the printing medium 12, the solid portion can be irradiated with the ultraviolet light after flattening it. Consequently, a high-gloss image can be obtained.

An example of the printing method of the outline portion and the solid portion is explained with reference to FIGS. 5A and 5B. For the sake of convenience, the ink constituting the outline portion is referred to as first ink and the ink constituting the solid portion is referred to as second ink. The ink is printed on the printing medium such that a relative size of the ink droplet of the first ink is small and a relative size of the ink droplet of the second ink is large. The ink droplet in the outline portion is of the size that is appropriate for forming the outline portion and the ink droplet in the solid portion is of the size that is appropriate for forming the solid portion. As can be inferred from FIGS. 3A and 3B, the outline portion is a narrow area that surrounds the solid portion 34; therefore, it can be formed by the small ink droplets. The solid portion is sandwiched between the outline portions 32 and 33 and is to be filled in; therefore, it can be formed by the large ink droplets. Thus, with the printing method described above, a desired shape of the outline portion can be obtained more accurately and printing of the solid portion can be performed effectively and rapidly.

As a method for performing the printing described above, a method by which the printing is performed on a printing medium using, for example, a so-called multi-tonal inkjet head is explained. Printing can be performed by controlling the size of the ink droplets using a method described below in the multi-tonal inkjet head.

When using the inkjet head that can perform printing using the piezo method according to the present embodiment, the number of the ink droplets to be sprayed at one place is adjusted by controlling the number of drive voltage pulses to be applied when the ink droplets are to be sprayed from nozzles of the inkjet head.

Figure 5A:
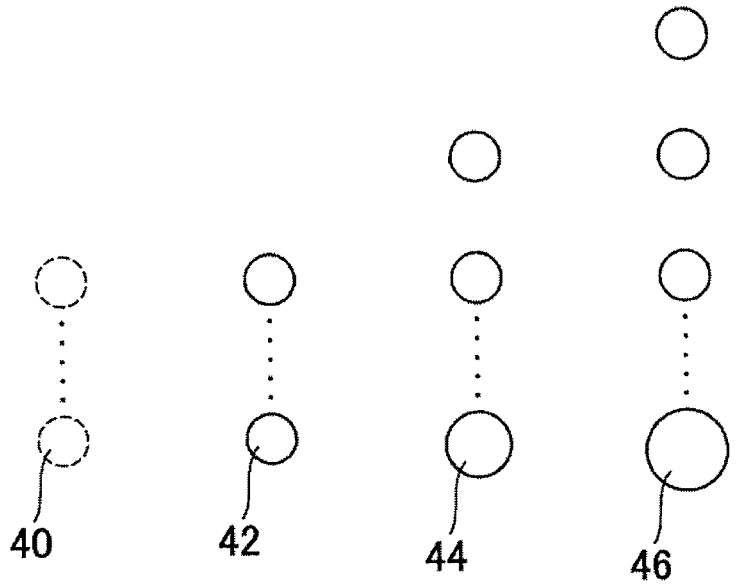
FIGS. 5A and 5B are schematic diagrams for explaining a printing method of an outline portion and a solid portion according to an embodiment of the present invention.

FIG. 5A shows the number of the ink droplets adjusted by controlling the number of the drive voltage pulses and a gradable variation in the relative sizes of the ink dots deposited on the printing medium when a four-tonal inkjet head is used. As shown in FIG. 5A, in the four-tonal inkjet head, the drive voltage pulse is controlled such that the ink is dribbled in four stages, that is, from zero droplets to three droplets. The dribbling of the ink is set such that it is a no dots 40 when zero droplets, a small dot 42 when one droplet, a medium dot 44 when two droplets, and a large dot 46 when three droplets. For example, when printing the outline portion, the drive voltage pulses are controlled such that one droplet of the ink is dribbled and the small dot 42 of the first ink that constitutes the outline portion is dribbled. When printing the solid portion, the drive voltage pulses are controlled such that the three droplets of the ink are dribbled and the large dot 46 of the second ink that constitutes the solid portion is dribbled.

When using an inkjet head that can perform printing using a variable dot method, the above described first ink and the second ink can be used in this method. In the variable dot method, the size of one dot to be deposited on the printing medium can be directly controlled in several stages. Therefore, in each of the outline portion and the solid portion, printing is performed by setting an optimum dot size for the portion.

Moreover, a method is considered by which the printing is performed using an inkjet head, which is not controlled by a printing method, but adaptable to the variation in the size of dots to be deposited on the printing medium.

For example, according to Structure 7 of the present invention, printing is performed using an inkjet head that includes ink discharging nozzles having different nozzle diameters of more than or equal to two types to obtain the desired dot size as described above. Specifically, an inkjet head that includes ink spray nozzles having diameters of various sizes is used. To print the outline portion and the solid portion in a desired dot size using such an inkjet head, the nozzle having the optimum size is selected from among the nozzles of various sizes.

Figure 5B:
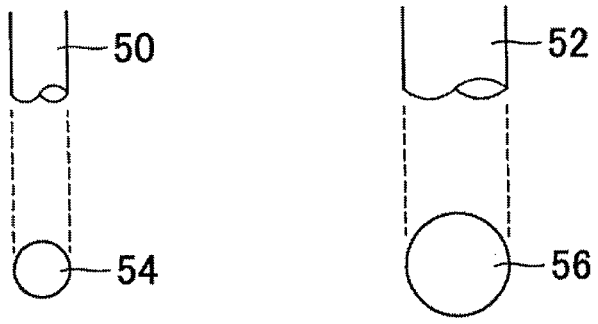

That is, as shown in FIG. 5B, a small nozzle 50 is used when printing the outline portion, and a large nozzle 52 is used when printing the solid portion. Thus, the relative size of the nozzle selected for printing is set such that it is larger when printing the solid portion as compared to when printing the outline portion. As a result, the size of the dot deposited on the printing medium is larger, that is, the dot deposited on the solid portion is a large dot 56 as compared to a small dot 54 deposited on the outline portion.

With such an inkjet head as described above, printing can be performed more accurately in the outline portion and effectively and rapidly in the It is desirable to print the ink constituting the outline portion and the ink constituting the solid portion such that both the inks overlap with each other in borders thereof. Thus, a gap that is likely to be formed between the outline portion and the solid portion can be avoided. Specifically, when printing the entire image with a UV curable clear ink, no problem will occur even if the outline portion and the solid portion overlap, and a high-gloss image can be obtained.

Alternatively, the outline portion can be printed with a clear ink and cured and the solid portion can be printed with a color ink and cured.

If the area of the solid portion in the image is wide, a thin splitting line can be printed for splitting the solid portion in a plurality of places simultaneously with printing the outline portion of the image with the clear ink. At this time, the thin line can be a grid line, a stripped line or a random line. Thus, a flattening time and a printing time can be shortened. The productivity can be increased and flattening can be reliably and reproducibly performed.

If the solid portion is irradiated with the ultraviolet light by the second ultraviolet irradiation unit 17 after the ink of the solid portion is flattened, a glossy and chromogenic image can be obtained. However, if there is an area to be produced with a matte effect, the ultraviolet light can be irradiated by the first ultraviolet irradiation units 15 and 16 immediately after the solid portion is printed.

The inkjet printer and the printing method according to the present invention are explained so far. However, the present invention is not limited to these examples. Various modifications may be made without departing from the spirit or scope of the general inventive concept as defined by the appended claims and their equivalents.

In the embodiments described above, the border portion is described as the outline portion. The border portion refers to borders of areas that are to be made visible by division. For example, a border is set for portions having a gradation difference more than or equal to 5% in adjacent image areas in target image data. Specifically, when two adjacent image areas are divided by one straight line, a linear border portion is obtained. Here, the gradation difference that is specified as more than or equal to 5% is merely an example, and any threshold value can be determined. If the gradation difference is less than 5%, patterns are assumed to be used for gradation expression.

When the gradation difference is less than 5%, border data is set by, for example, subjecting the pixel data to differentiation, detecting change points, and connecting the change points with a data string. As a result, a case where the border portion is printed in the image area is as likely as a case where a shape surrounding the border of the image area is obtained.

An image data splitting process for splitting the print-targeted image data into the image area portion and the border portion needs to be performed before performing a border printing process. The image data splitting process can be realized by execution of a computer program by a computer that transfers the image data to the inkjet printer.

In the embodiment described above, a case where scanning involves a two dimensional relative movement of the printing medium 12 and the inkjet head 14 is explained as an example. However, the relative movement of the printing medium 12 and the inkjet head 14 can be three dimensional. For example, when printing on a printing medium having an irregular surface, the inkjet head 14 is moved vertically so that a constant head gap that is suited to the geometry of the irregular surface is maintained.

In the embodiment described above, the inkjet printer that prints an image is explained as an example. However, any printer that can discharge and deposit ink droplets on a printing medium using an inkjet technology can be used. For example, the present invention is applicable even when forming, for example, a color filter using the inkjet technology. That is, by forming an outline in a grid-shape using the inkjet technology and curing it by an energy light, a black matrix is formed and color ink is deposited in the black matrix.

INDUSTRIAL APPLICABILITY

The present invention is applicable to the inkjet printer and the inkjet printing method in which the image formed of an array of the ink droplets is printed by spraying the ink droplets from the inkjet head.

The invention claimed is:

1. An inkjet printing method by which an image formed of an array of ink droplets is printed on a surface of a printing medium by an inkjet head that scans relative to the printing medium and includes a plurality of discharge ports to discharge ink in the form of droplets, based on an image data that includes an image area portion divided into a plurality of image areas and a outline portion that divides the image area portion, the ink being an energy light curable ink, the inkjet printing method sequentially comprising:

a border printing step of printing the outline portion;

a border curing step of curing the printed outline portion by irradiating an energy light;

an image area printing step of printing the image area portion adjacent to the outline portion that is cured at the border curing step; and an image area curing step of curing the printed image area portion by the energy light, wherein each of ink droplets in an array forming the outline portion is smaller than each of ink droplets in an array forming the image area portion, and the outline portion is set for portions having a gradation difference in adjacent image areas, the gradation difference is obtained by subjecting a plurality pixel data to differentiation, detecting a plurality of change points, and connecting the change points with a data string.

2. The inkjet printing method according to claim 1, wherein the border curing step is performed by an energy-light irradiation unit that is arranged at least either frontward or backward in a scanning direction of the inkjet head coaxially with a scanning axis of the inkjet head, and that operates with the inkjet head.

3. The inkjet printing method according to claim 1, wherein the image area curing step is performed by an energy-light irradiation unit that is arranged frontward in a conveyance direction of the printing medium relative to the inkjet head.

4. The inkjet printing method according to claim 1, wherein at least either the ink constituting the outline portion or the ink constituting the image area portion is a clear ink.

5. The inkjet printing method according to claim 4, wherein the ink constituting the outline portion and the ink constituting the image area portion are printed such that both the inks overlap with each other in borders thereof.

6. The inkjet printing method according to claim 1, wherein the printing is performed by an inkjet head that includes ink discharge nozzles having different nozzle diameters of more than or equal to two types.

7. The inkjet printing method according to claim 1, wherein the image area curing step is performed by irradiating the image area portion with the energy light after the ink of the image area portion printed at the image area printing step is flattened.

8. The inkjet printing method according to claim 1, further comprising, prior to the border printing step, an image data splitting step of splitting print-targeted image data into the image area portion that is divided into a plurality of image areas and the outline portion that divides the image area portion.

* * * * *